US005379567A

United States Patent [19]

Vahey

[11] Patent Number: 5,379,567

[45] Date of Patent: Jan. 10, 1995

[54] STRUCTURAL MEMBER

[76] Inventor: Michael Vahey, 19 Norwood Ct., Medord, N.J. 08055

[21] Appl. No.: 17,688

[22] Filed: Feb. 12, 1993

[51] Int. Cl.[6] ..... E04C 3/34

[52] U.S. Cl. ..... 52/724; 52/309.14; 52/725; 52/727; 52/731.2; 52/732.1

[58] Field of Search ..... 52/720, 733, 740, 730.1, 52/730.4, 730.5, 730.6, 731.1, 731.2, 731.3, 731.4, 731.5, 731.7, 732.1, 732.2, 732.3, 737, 738, 724, 725, 727, 728, 309.14; 29/897, 897.31, 897.35, 530, 897.33; 72/379.2, 379.6; 228/173.4

[56] References Cited

U.S. PATENT DOCUMENTS

| | | | |
|---|---|---|---|
| 1,364,182 | 1/1921 | Conkling . | |
| 2,007,597 | 7/1935 | Dean | 29/897.33 |
| 2,192,904 | 3/1940 | Ferris | 228/173.4 |
| 3,098,266 | 7/1963 | Oehmig | 52/213 |
| 3,516,211 | 6/1970 | Rieve . | |

FOREIGN PATENT DOCUMENTS

| | | | |
|---|---|---|---|
| 166177 | 5/1954 | Australia | 52/737 |

OTHER PUBLICATIONS

"Spraying Steel," The MIT Report Dec./Jan. 1991-1992, p. 3.

*Primary Examiner*—Michael Safavi
*Attorney, Agent, or Firm*—Ratner & Prestia

[57] ABSTRACT

The present invention pertains to a structural member comprising three elongated planar rectangular sheets, each sheet having a long edge and short edge, and joined by its long edge to two other sheets. The sheets thus form an elongated triangular columnar member. Each sheet has a series of semi-ellipsoid indentations extending into the triangular columnar member. The resultant structural member has rigidity in a direction perpendicular to its long axis, but has torsional flexibility around its axis. The member may also include stabilizing rods with extending axially through the member and may be filled with a stiffening agent, including polymeric resin or cement.

16 Claims, 5 Drawing Sheets

STRUCTURAL MEMBER

BACKGROUND OF THE INVENTION

The present invention relates to structural members, particularly beams and other similar members used in construction. The structural member can be used in cars, houses or other areas where strong rigid structural members are needed. The structural members may be made in a variety of sizes, strengths and weights.

Structural members are frequently used in construction today. However, there exist few basic structural members, and few developments of the basic members have been made.

Rectangular cut lumber, in conjunction with I beams, box beams, rectangular metal members, and combinations thereof comprise the extent of the structural members available today. While these building materials are generally adequate for most purposes, it would be desirable to have a structural member which is rigid along its axial length, but allows torsional flexibility, while maintaining light weight and structural integrity. Such a structural member has now been developed.

SUMMARY OF THE INVENTION

The present invention pertains to a structural member comprising three elongated planar rectangular sheets, each sheet having a long edge and short edge, and joined by its long edge to two other sheets. The sheets thus form an elongated triangular columnar member. Each sheet has a series of semi-ellipsoid indentations extending into the triangular columnar member. These semi-ellipsoids are coordinated on two faces of the member, and staggered on the third. The resultant structural member has rigidity in a direction perpendicular or parallel to its long axis, but has torsional flexibility around its axis. The member may also include stabilizing rods extending axially through the member. Further, if torsional flexibility is not desired, the member may be filled with a stiffening agent, such as a polymeric resin or cement.

DESCRIPTION OF THE PREFERRED EMBODIMENTS

Figure 5:
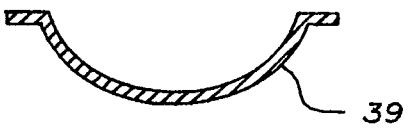
FIG. 5 is a partial cross-sectional view taken along the line 5—5 in FIG. 3 of a structural member according to the present invention.
Figure 6:
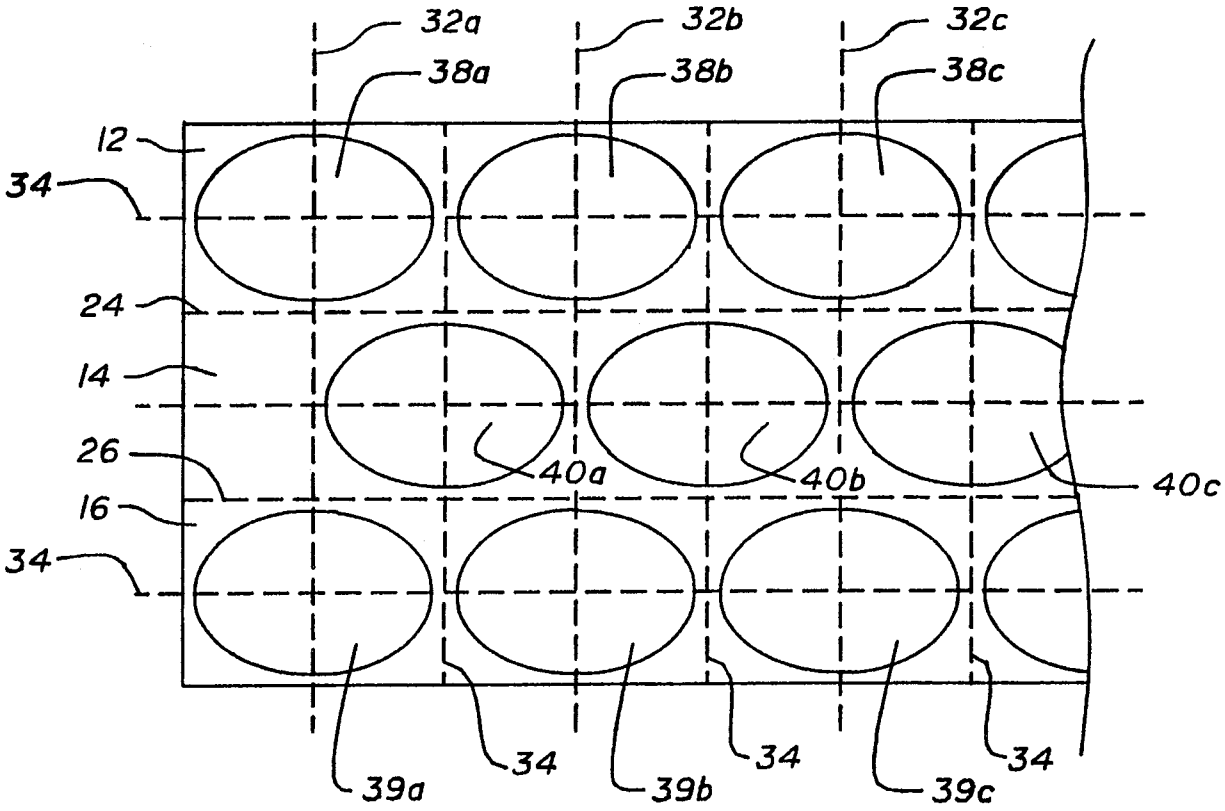
FIG. 6 is a plan view of a structural member according to the present invention showing the relationship among semi-ellipsoids.

Referring now to the figures, structural member 10 comprises three generally planar sides 12, 14, and 16, along with connecting flap 18. Sides 12, 14 and 16 are generally planar, but each includes a series of semi-ellipsoidal indentations 38, 39, and 40 in an arrangement which can most easily be seen from FIG. 6. Each semi-ellipsoidal indentation 38, 39, or 40 forms an ellipse where it meets the surface of side 12, 14, or 16. The cross-section of a semi-ellipsoidal indentation 38, 39, or 40 taken in a plane perpendicular to the long axis of the structural member, is generally semi-elliptical as shown in FIG. 5. However the size of the indentation 38, 39, or 40 and the size of the structural member dictate the size and shape the cross-section of the indentation 38, 39, or 40. Therefore the cross-section of the indentation may also be semi-circular if necessary.

Although semi-ellipsoid indentations 38, 39 and 40 may vary in size, it is preferable for all of the semi-ellipsoid indentations 38, 39, and 40 to be of the same sized or at least for the indentations 38 and 39 located on sides 12 and 16, to be the same size. The reason for this is the coordinated locations of the semi-ellipsoid indentations 38 and 39 on sides 12 and 16, as will be explained presently.

Figure 3:
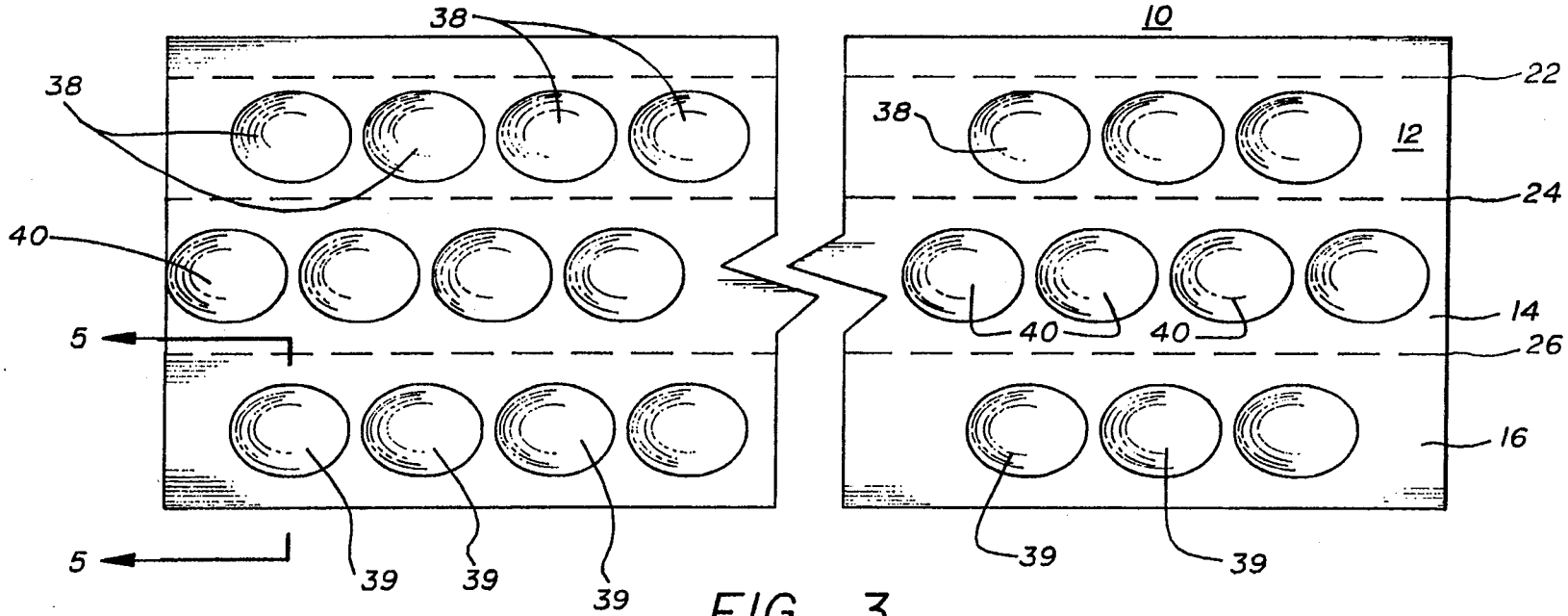
FIG. 3 is a plan view of a structural member according to the present invention in a fully unfolded position.

Structural member 10 may be made in a flat open configuration as shown in FIG. 3, prior to folding it into a panel form. The structural member is then formed by folding sides 12, 14, and 16 and connector flap 18 along creases 22, 24 and 26. Connector flap 18 is then secured to side 16 to form triangular structural member 10. Connector flap 18 can be secured by any conventional method appropriate for the material from which the structural member is formed including welding, brazing, gluing, sonic welding, etc.

As shown in FIG. 3, the open flattened form has semi-ellipsoidal indentations 38, 39, and 40 arranged in three staggered rows. This may also be seen from FIG. 6. The semi-ellipsoidal indentations 38 and 39 on sides 12 and 16 are coordinated in that the centers of two corresponding semi-ellipsoidal indentations fall on a single line 32 perpendicular to the length of structural member 10. For instance, indentations **38*a* and 39*a* fall on line 32*a*, indentations 38*b* and 39*b* on line 32*b***, and so on.

The ellipsoidal indentations 38, 39, or 40 on any one particular side are arranged along a single line 34 running parallel to the length of the structural member. The indentations 40 on side 14 are offset from indentations 38 and 39 on sides 12 and 16 by one-half the distance between the centers of two adjacent ellipsoids. In other words, the center of an ellipsoid **40*a* on side 14 is exactly half way between the centers of two adjacent indentations 38*a* and 38*b* on side 12, or 39*a* and 39*b* on 16. Furthermore, the indentations on each side are in the center of the side between the two long ends (e.g. the centers of indentations 40*a*, 40*b*, and 40*c* on side 14 are halfway between fold 24 and fold 26). The depth of each indentation is calculated such that when structural member 10 is folded into its final form, each semi-ellipsoidal indentation will contact semi-ellipsoidal indentations on adjacent sides. Each of the indentations 38 and 39 will contact its corresponding indentation 39 or 38. That is, indentation 38*a* will contact indentation 39*a*, indentation 38*b* will contact indentation 39*b*, etc. Furthermore, each indentation 40 on side 14 will contact four other indentations, two on each of sides 12 and 16. Indentation 40*a* will contact indentations 38*a*, 38*b*, 39*a*, and 39*c* when structural member 10** is folded to its final form.

This contact among indentations is very important. The triangular shape of the structural member provides torsional flexibility to the member. With one end of the structural member 10 held rigidly, the other end can be rotated about the long axis of the structural member, i.e. around an axis parallel to one of the folds 22, 24 and 26. When the structural member of the present invention is twisted in this manner, the semi-ellipsoidal indentations slide against one another, while maintaining contact. This contact helps prevent failure and crumpling of the structural member upon such twisting, thereby adding to the range of rotation tolerable by the structural member.

The semi-ellipsoidal indentations also lend structural rigidity to each individual sheet by interrupting the planar face of the sheet. Thus, increased strength and rigidity is experienced with respect to forces applied perpendicular or parallel to the long axis of the structural member, while rotational and torsional flexibility is increased.

Figure 1:
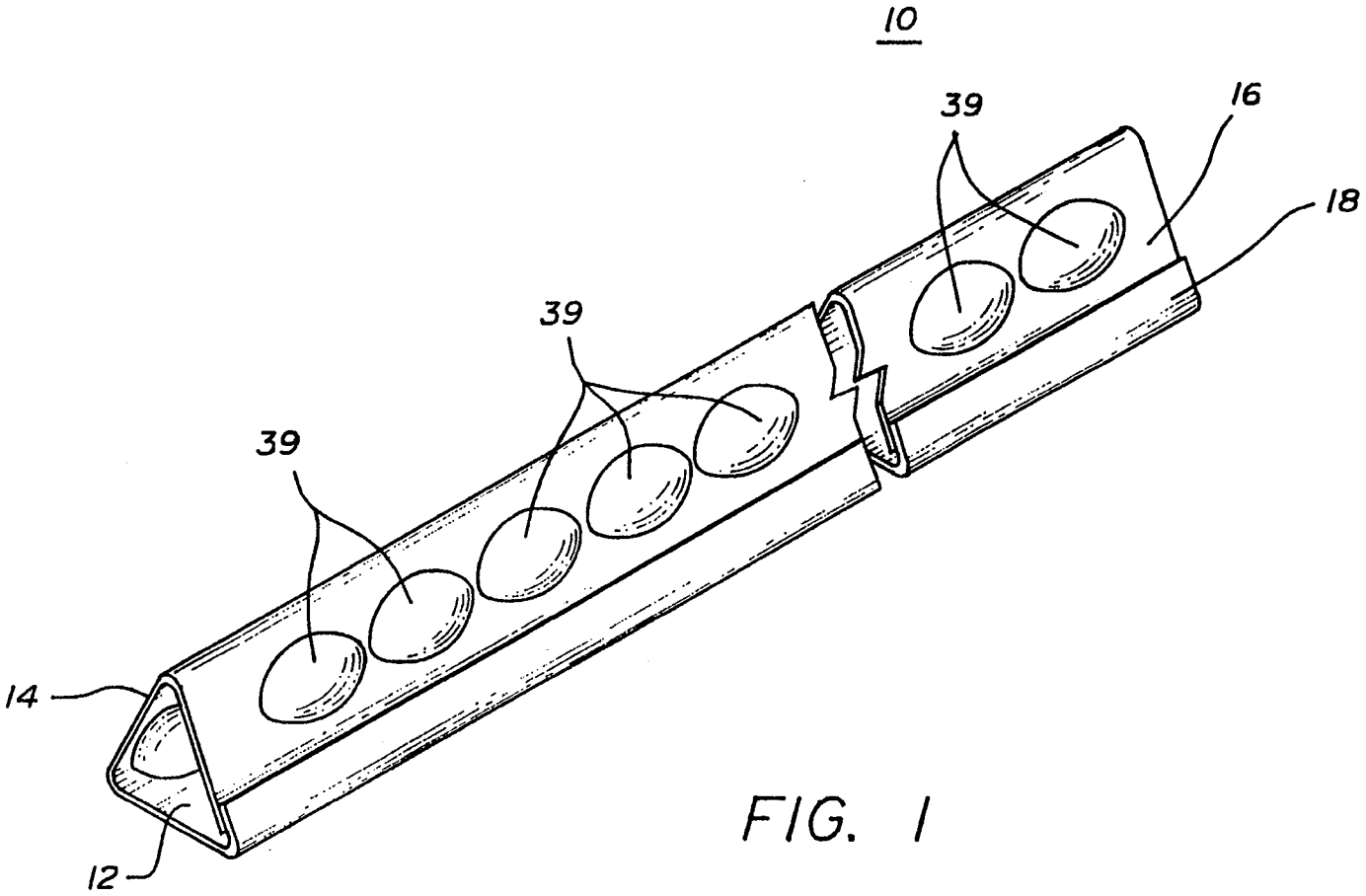
FIG. 1 is a perspective view of a structural member according to the present invention.
Figure 2:
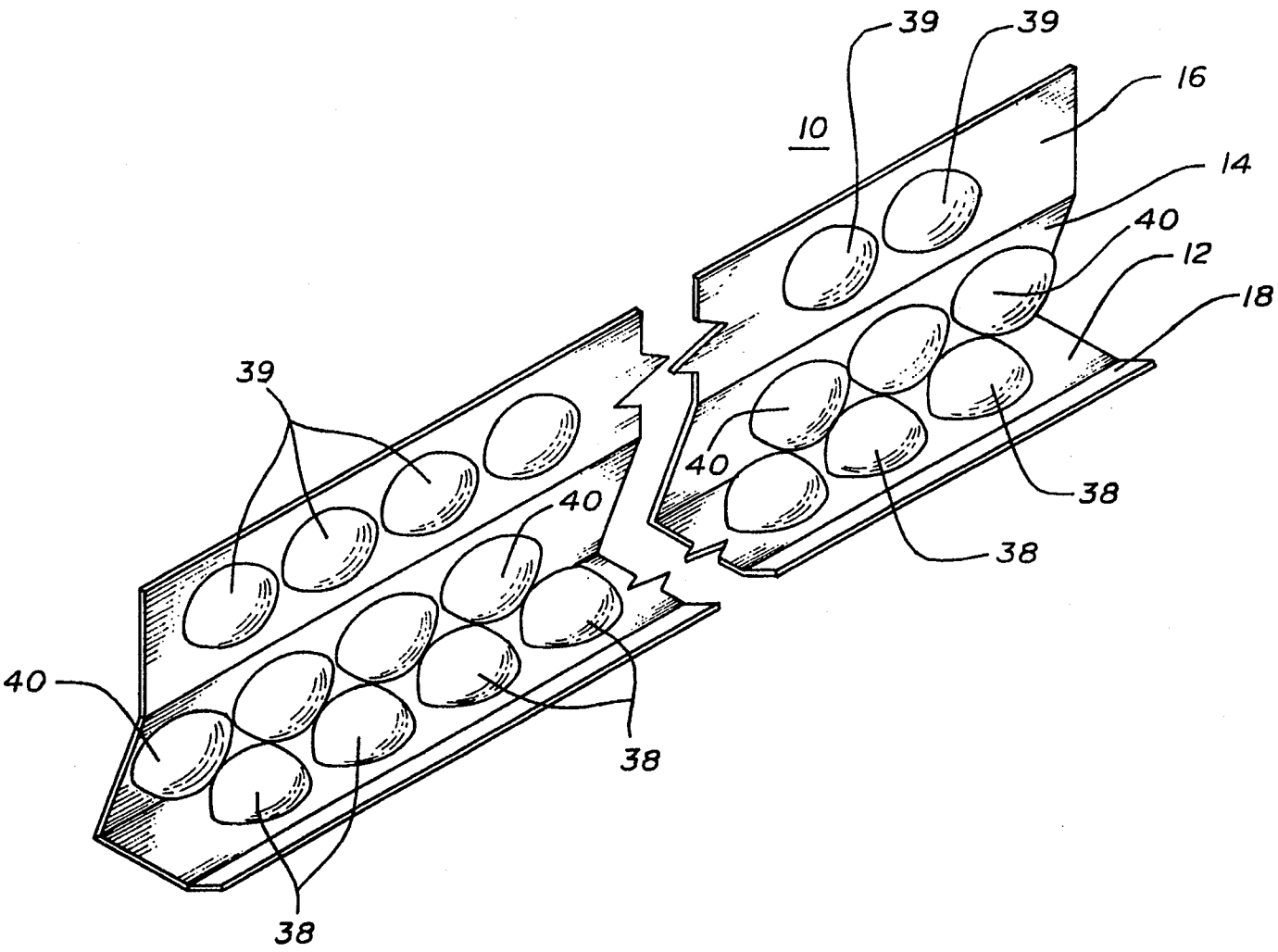
FIG. 2 is a perspective view of a structural member according to the present invention in a partially unfolded position.
Figure 4:
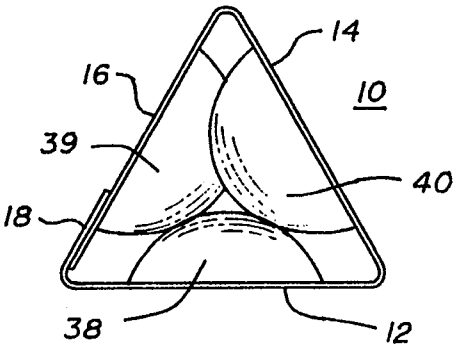
FIG. 4 is an end view of a structural member according to the present invention.

The structural member may be manufactured in any of several different ways. Die stamping continuous sheets of metal with semi-ellipsoid indentations can be used to create flat sheets as shown in FIG. 3, which can then be folded into the structural member along folds 22, 24, and 26. Alternatively, sheets such as those shown in FIG. 3 may be made by spray depositing steel or other metal onto a form having the shape of the sheet shown in FIG. 3. Again, the sheet would then be folded into the final configuration as shown in FIGS. 1, 2 and 4.

Once the structural member 10 is completed, added rigidity may be provided by filling the inside of the structural member with a stiffening agent. The stiffening agent may comprise any number of well-known structural hardening materials, including cement, polymeric resins, and or filler materials. Such a stiffening agent will decrease the torsional flexibility of the structural member, but will increase the overall rigidity and strength of the structural member. Of course, the stiffening agent will also increase the overall weight of the structural member, and may therefore be undesirable.

The structural member may alternatively be made by molding a durable material such as a synthetic polymeric resin into an appropriately machined mold. For small members of definite length, injection blow molding would be an appropriate fabrication method. Extrusion blow molding may also be used to produce the structural member of the present invention.

Injection molding can also be used if a solid plastic member is desired. Such a solid injection molded member would not have the torsional flexibility of the hollow member.

The structural member may be made in any convenient size, using metal or materials of appropriate thickness. In whatever size chosen, however, the semi-ellipsoid indentations present on the three sides of the member should have a size calculated to contact one another in the manner previously described when the member is completely folded.

Figure 7:
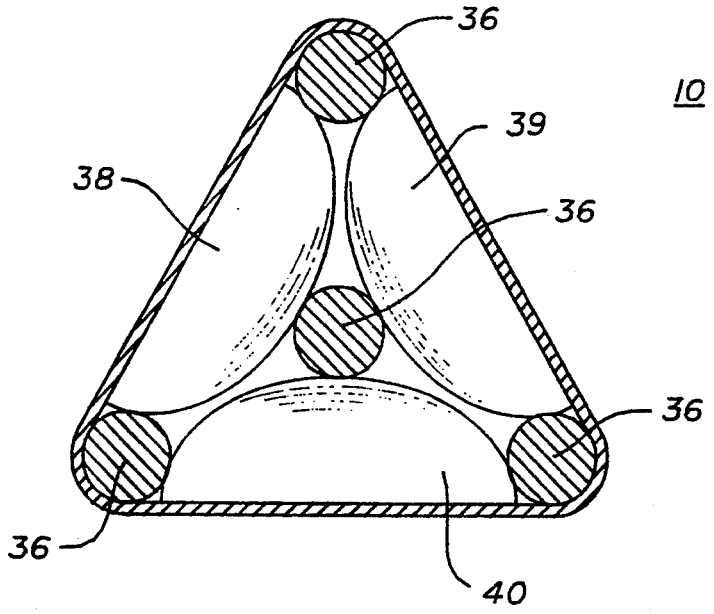
FIG. 7 is an end view of an alternative embodiment of a structural member according to the present invention.
Figure 8:
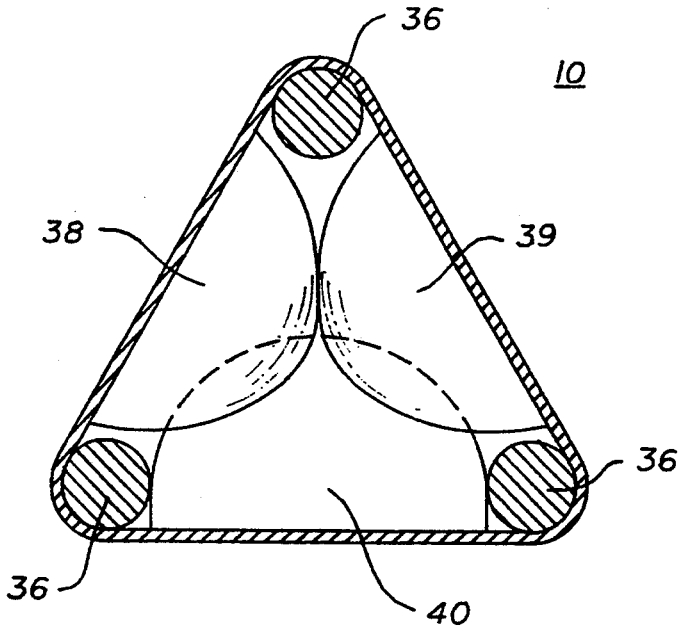
FIG. 8 is an end view of an alternative embodiment of a structural member according to the present invention.

Two alternative configurations of structural member 10 are shown in FIGS. 7 and 8, respectively. In FIG. 7, the semi-ellipsoidal indentations 38, 39, and 40 are made somewhat smaller than in the configuration shown in FIGS. 1 through 6. In the configuration shown in FIG. 7, the semi-ellipsoidal indentations do not touch one another. Consequently, there are spaces between the indentations. These spaces are occupied by rods 32. Rods 32 may be made from steel, carbon fiber, polymeric material, or other rigid material. The rods add stiffness and strength to structural member 10, while allowing form bending of the structural member.

In a still further alternative embodiment, structural member 10 can have only three rods extending therethrough as shown in FIG. 8. In this case, the semi-ellipsoidal indentations are made slightly smaller where they contact sides 12, 14, and 16, but sufficiently deep to allow the semi-ellipsoid indentations to contact one another in the center of the member.

Further, if the structural member is to be bent, semi-ellipsoid indentations 38, 39, and 40 may be made slightly smaller so the indentations do not touch each other, or do not touch rods 32. Structural member 10 can then be stretch bent. When this occurs, the member will decrease in cross-sectional area, and the semi-ellipsoidal indentations will then touch one another or rods 32 as appropriate.

Either of the alternative configurations shown in FIGS. 7 and 8 can be made by wrapping cloth around the three rods 32, impregnating the cloth with a hardening resin, such as a polymeric resin, and placing the impregnated cloth wrapped rods in a mold in order to allow the polymeric resin to cure.

The structural member may also be manufactured by continuous extrusion of a triangular pipe which is then passed through a shaping mechanism to add the ellipsoids to the three sides. In this way, flap 18 and the need to fold metal and seal flap 18 to side 16 may be eliminated. This would result in a seamless structural member. Seamless structural members including stiffening rods are shown in FIGS. 7 and 8.

It is understood that various other modifications will be apparent and can readily be made by those skilled in the art without departing from the spirit and scope of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed:

1. A structural member comprising:

an elongated triangular member having three elongated planar rectangular sheets and a connecting flap, said triangular member formed from a single folded elongated planar member, each said sheet having a long edge and a short edge;

said member including a central cavity extending therethrough;

each said sheet having a plurality of semi-ellipsoid indentations therein;

wherein said semi-ellipsoid indentations in one said sheet contact said semi-ellipsoid indentations in each of said other two sheets.

2. The structural member of claim 1, wherein said semi-ellipsoids are defined by rotation of 45° ellipses around their long axes.

3. The structural member of claim 1, wherein said semi-ellipsoids are defined by rotation of 45° ellipses around their long axes.

4. A structural member comprising:

an elongated triangular member having three elongated planar rectangular sheets and a connecting flap, said triangular member formed from a single folded elongated planar member, each said sheet having a long edge and a short edge;

said member including a central cavity extending therethrough;

each said sheet having a plurality of semi-ellipsoid indentations therein;

wherein each said sheet has a long axis parallel to said long edge, and said semi-ellipsoid indentations are equally spaced along said long axis and are arranged with the long axes of said semi-ellipsoid indentations on said long axis of each said sheet; and wherein said semi-ellipsoid indentations in one said sheet contact said semi-ellipsoid indentations in each of said other two sheets.

5. The structural member of claim 4, wherein said semi-ellipsoids are defined by rotation of 45° ellipses around their long axes.

6. A structural member comprising:

an elongated triangular member having three elongated planar rectangular sheets and a connecting flap, said triangular member formed from a single folded elongated planar member, each said sheet having a long edge and a short edge;

said member including a central cavity extending therethrough;

each said sheet having a plurality of semi-ellipsoid indentations therein; and said structural member further comprising three rods located at the apexes of, and inside of said triangular member, said rods extending through said member parallel to said long edges.

7. The structural member of claim 6 further including a fourth rod extending through the center of said member parallel to said other three rods.

8. The structural member of claim 7 wherein said semi-ellipsoid indentations contact said fourth rod and hold said fourth rod in the center of said member.

9. The structural member of claim 6 wherein said rods comprise a material selected from the group consisting of graphite fiber and steel.

10. The structural member of claim 7 wherein said rods comprise a material selected from the group consisting of graphite fiber and steel.

11. The structural member of claim 6 wherein said central cavity is filled with a stiffening agent.

12. The structural member of claim 7 wherein said central cavity is filled with a stiffening agent.

13. A structural member comprising:

an elongated triangular member having three elongated planar rectangular sheets and a connecting flap, said triangular member formed from a single folded elongated planar member, each said sheet having a long edge and a short edge;

said member including a central cavity extending therethrough;

each said sheet having a plurality of semi-ellipsoid indentations therein;

wherein: each said sheet has a long axis parallel to said long edge, and said semi-ellipsoid indentations are equally spaced along said long axis and are arranged with the long axes of said semi-ellipsoid indentations on said long axis of each said sheet;

centers of said semi-ellipsoids are positioned at equal predetermined intervals along each of said sheets;

said semi-ellipsoids on a first sheet are positioned such that the center of the semi-ellipsoid on said first sheet nearest a first end of said member is a first predetermined distance from said end;

said semi-ellipsoids on a second and a third sheet are positioned such that the centers of the semi-ellipsoids on each said second and said third sheet nearest said first end of said member are a second predetermined distance from said end; and said second predetermined distance differs from said first predetermined distance by one half of one of said equal intervals.

14. The structural member of claim 13 wherein said semi-ellipsoid indentations in one said sheet contact said semi-ellipsoid indentations in each of said other two sheets.

15. The structural member of claim 14, wherein said semi-ellipsoids are defined by rotation of 45° ellipses around their long axes.

16. The structural member of claim 13 wherein said member is formed from steel.

* * * * *

UNITED STATES PATENT AND TRADEMARK OFFICE

CERTIFICATE OF CORRECTION

PATENT NO. : 5,379,567
DATED : January 10, 1995
INVENTOR(S) : Michael Vahey

It is certified that error appears in the above-identified patent and that said Letters Patent is hereby corrected as shown below:

In the front page, item 76, delete "Medord" and insert --Medford--.

In column 3, line 68, delete "32" and insert --36--.

In column 4, line 4, delete "32" and insert --36--.

Signed and Sealed this

Third Day of October, 1995

*Attest:*

*Attesting Officer*

BRUCE LEHMAN

*Commissioner of Patents and Trademarks*